US011440729B2

(12) United States Patent
Kobane

(10) Patent No.: US 11,440,729 B2
(45) Date of Patent: Sep. 13, 2022

(54) VACUUMING REFUSE CONTAINER ASSEMBLY

(71) Applicant: Kenneth Kobane, Santee, CA (US)

(72) Inventor: Kenneth Kobane, Santee, CA (US)

( * ) Notice: Subject to any disclaimer, the term of this patent is extended or adjusted under 35 U.S.C. 154(b) by 854 days.

(21) Appl. No.: 16/351,648

(22) Filed: Mar. 13, 2019

(65) Prior Publication Data

US 2020/0290799 A1 Sep. 17, 2020

(51) Int. Cl.

| | |
|---|---|
| ***B65D 25/14*** | (2006.01) |
| ***B65F 1/10*** | (2006.01) |
| ***B65F 1/16*** | (2006.01) |
| ***B65F 1/08*** | (2006.01) |

(52) U.S. Cl.

CPC ..... *B65F 1/105* (2013.01); *B65F 1/08* (2013.01); *B65F 1/1607* (2013.01); *B65F 2210/168* (2013.01); *B65F 2210/179* (2013.01)

(58) Field of Classification Search

CPC .. B65F 1/05; B65F 1/08; B65F 1/1607; B65F 2210/168; B65F 2210/179; B65F 2210/198

USPC ..... 220/908, 495.01, 495.04, 495.06, 908.1, 220/661

See application file for complete search history.

(56) References Cited

U.S. PATENT DOCUMENTS

| | | | | |
|---|---|---|---|---|
| 3,835,767 | A | 9/1974 | Peterson | |
| 3,899,967 | A | 8/1975 | Powers | |
| 4,748,905 | A | 6/1988 | Langdon | |
| 5,083,509 | A | 1/1992 | Hansen | |
| 5,220,866 | A | 1/1993 | Mason, Jr. | |
| D353,249 | S | 12/1994 | Hallenbeck | |
| 9,003,967 | B2 | 4/2015 | Reed | |
| 2003/0136279 | A1 | 7/2003 | Tarlow | |
| 2006/0175336 | A1* | 8/2006 | Wang | B65F 1/163 220/495.04 |
| 2009/0095755 | A1* | 4/2009 | McCurry | B65F 1/06 220/495.04 |
| 2013/0019901 | A1* | 1/2013 | Gerhards | A47L 9/2821 134/21 |
| 2020/0017292 | A1* | 1/2020 | Eiler | B65F 1/065 |

* cited by examiner

*Primary Examiner* — Don M Anderson
*Assistant Examiner* — Elizabeth J Volz

(57) ABSTRACT

A vacuuming refuse container assembly includes a refuse container for receiving refuse for disposal. A lid is removably positioned on the refuse container and the lid has a refuse opening extending therethrough to receive the refuse. A control circuit is coupled to the refuse container and a vacuum unit is positioned within the refuse container. The vacuum unit is electrically coupled to the control circuit and the vacuum unit is in fluid communication with the refuse opening in the lid. The vacuum unit urges air inwardly through the refuse opening when the vacuum unit is turned on. Thus, refuse placed in the refuse opening is drawn downwardly into the refuse container. A motion sensor is coupled to the refuse container. The vacuum unit is turned on when the motion sensor senses motion of the refuse being placed in the refuse opening.

7 Claims, 5 Drawing Sheets

VACUUMING REFUSE CONTAINER ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art including information disclosed under 37 CFR 1.97 and 1.98

The disclosure and prior art relates to refuse container devices and more particularly pertains to a new refuse container device employing suction to urge refuse fully into a refuse container.

BRIEF SUMMARY OF THE INVENTION

An embodiment of the disclosure meets the needs presented above by generally comprising a refuse container for receiving refuse for disposal. A lid is removably positioned on the refuse container and the lid has a refuse opening extending therethrough to receive the refuse. A control circuit is coupled to the refuse container and a vacuum unit is positioned within the refuse container. The vacuum unit is electrically coupled to the control circuit and the vacuum unit is in fluid communication with the refuse opening in the lid. The vacuum unit urges air inwardly through the refuse opening when the vacuum unit is turned on. Thus, refuse placed in the refuse opening is drawn downwardly into the refuse container. A motion sensor is coupled to the refuse container. The vacuum unit is turned on when the motion sensor senses motion of the refuse being placed in the refuse opening.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
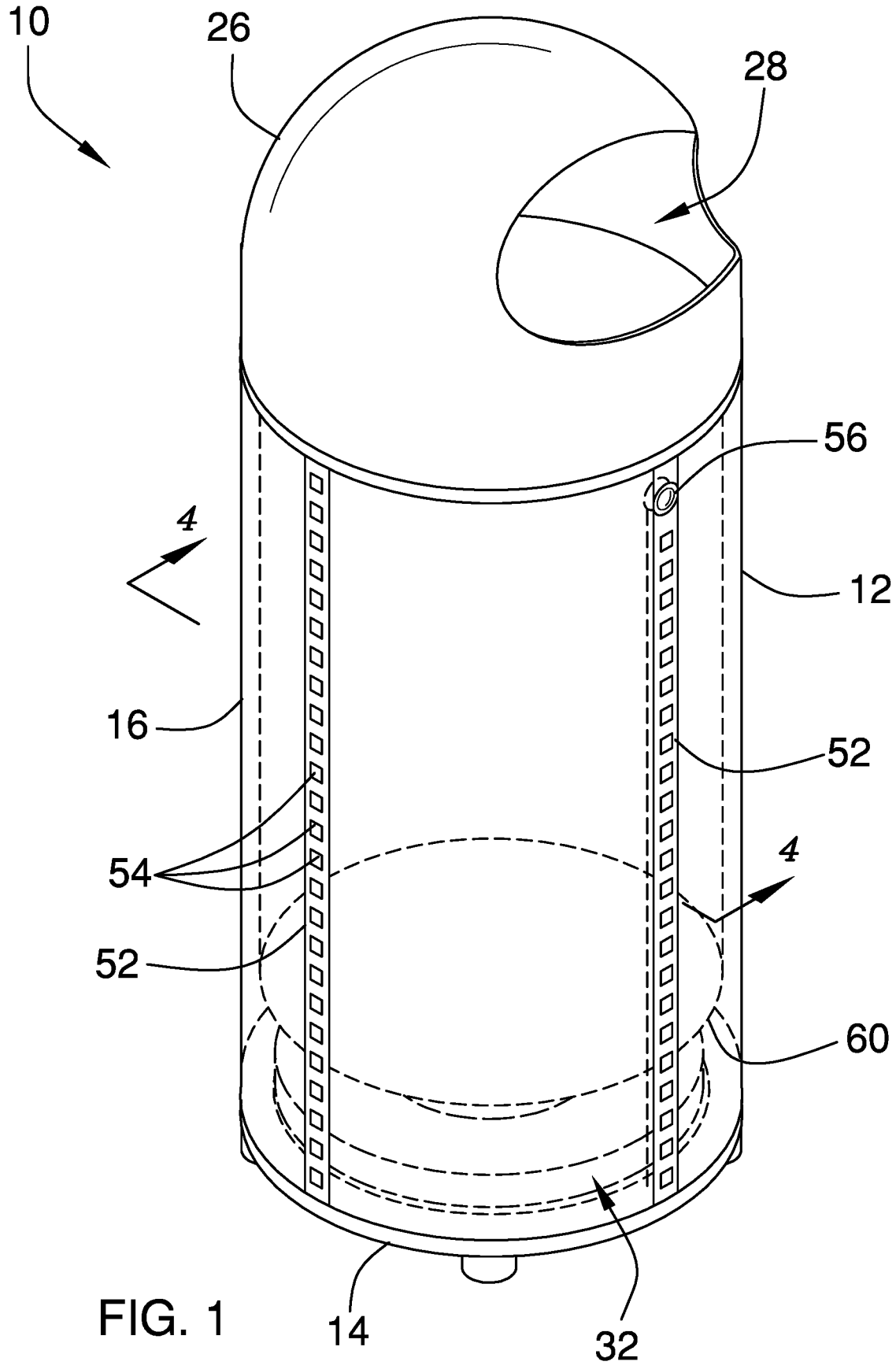
FIG. 1 is a perspective phantom view of a vacuuming refuse container assembly according to an embodiment of the disclosure.
Figure 2:
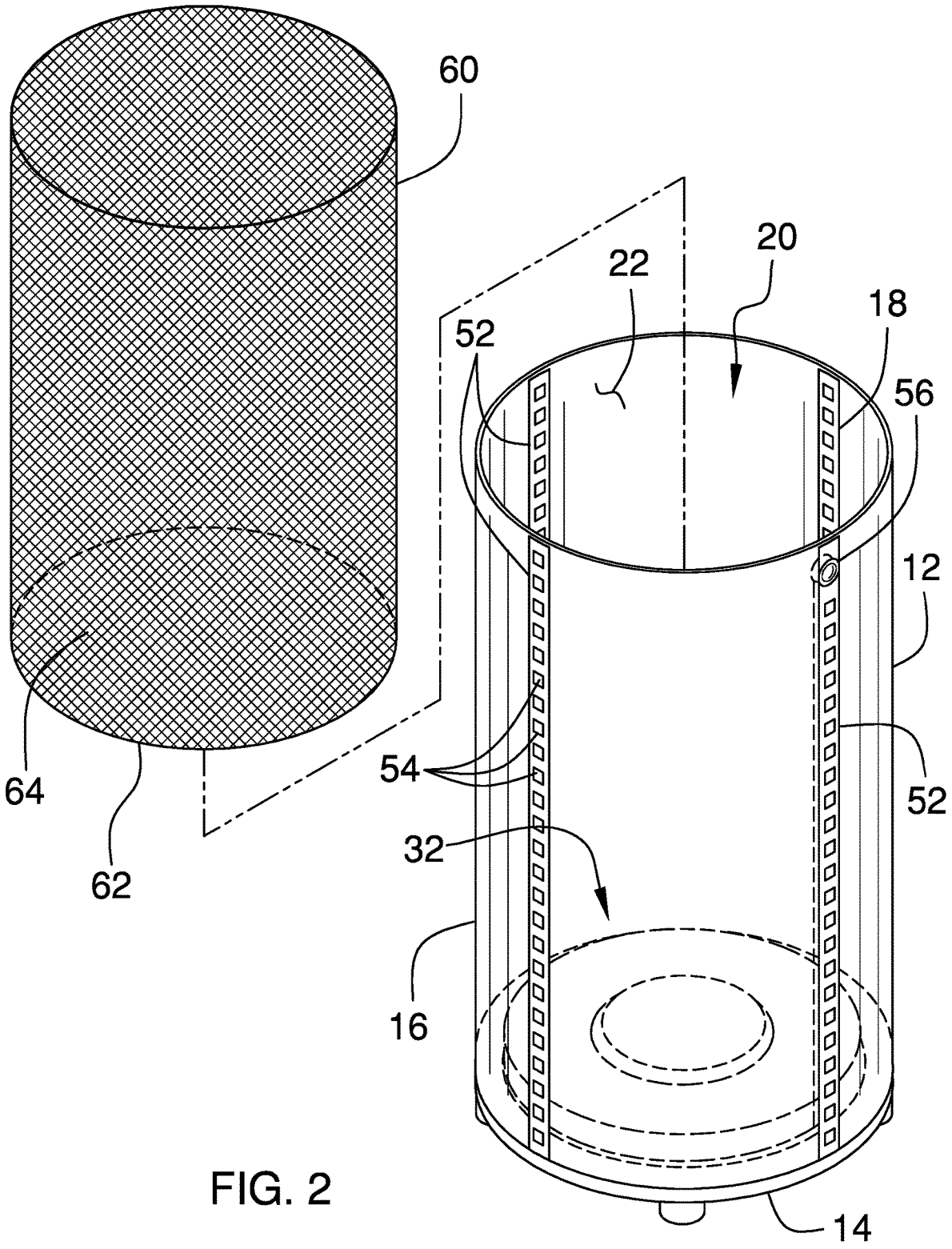
FIG. 2 is an exploded perspective view of an embodiment of the disclosure.
Figure 3:
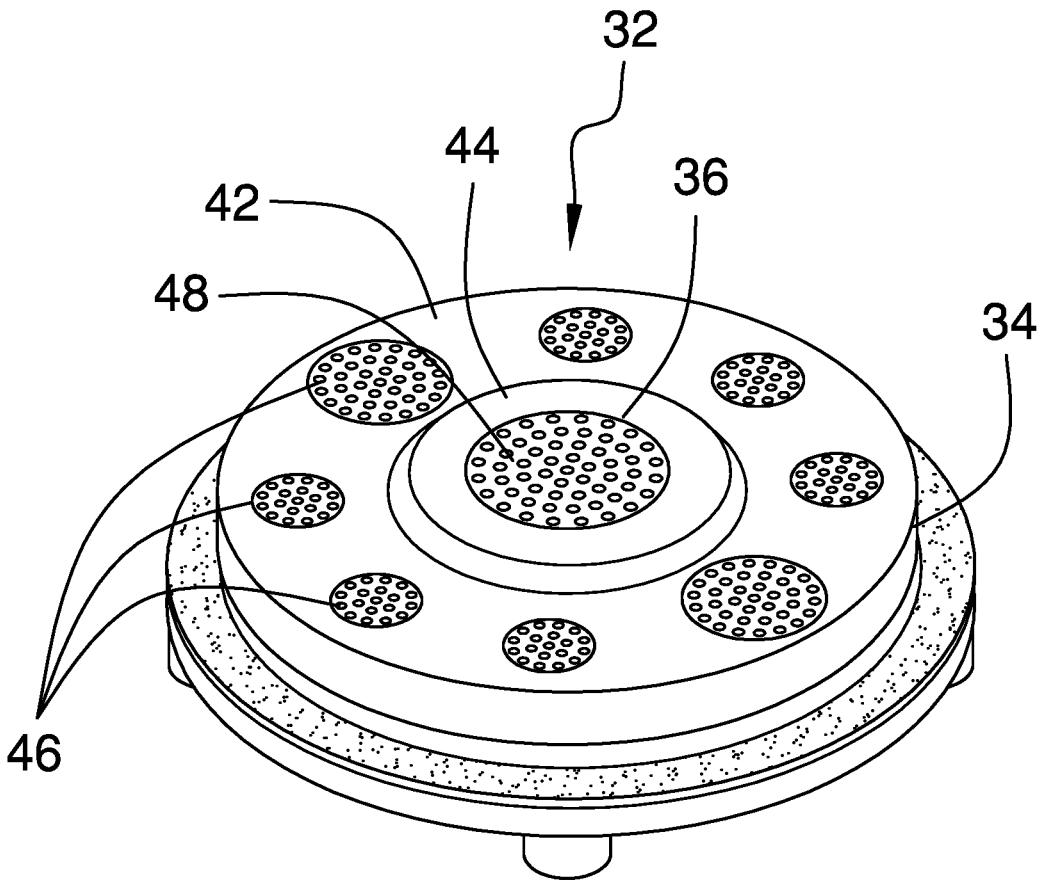
FIG. 3 is a top perspective view of vacuum unit of an embodiment of the disclosure.
Figure 4:
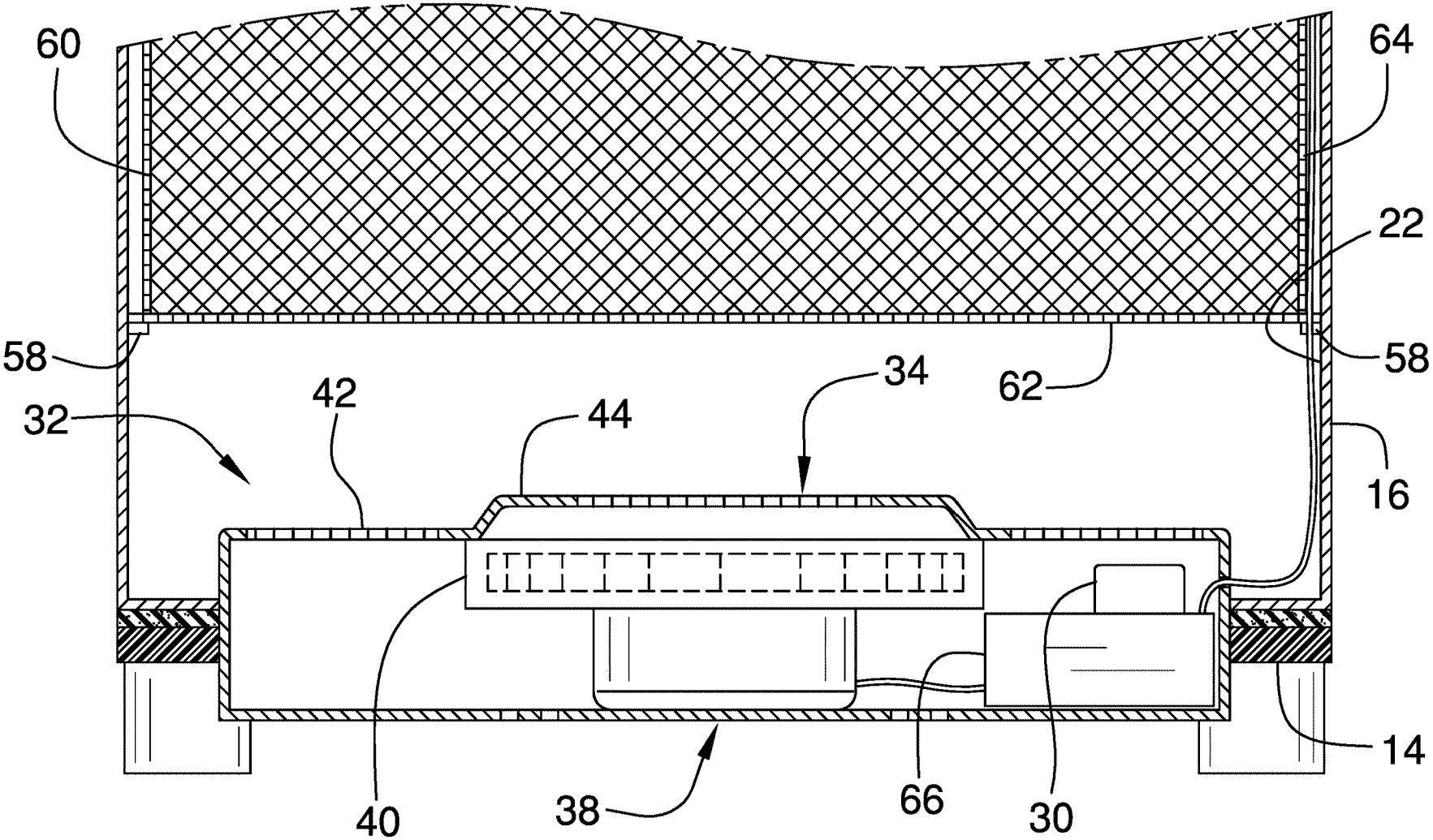
FIG. 4 is a cross sectional view taken along line 4-4 of FIG. 1 of an embodiment of the disclosure.
Figure 6:
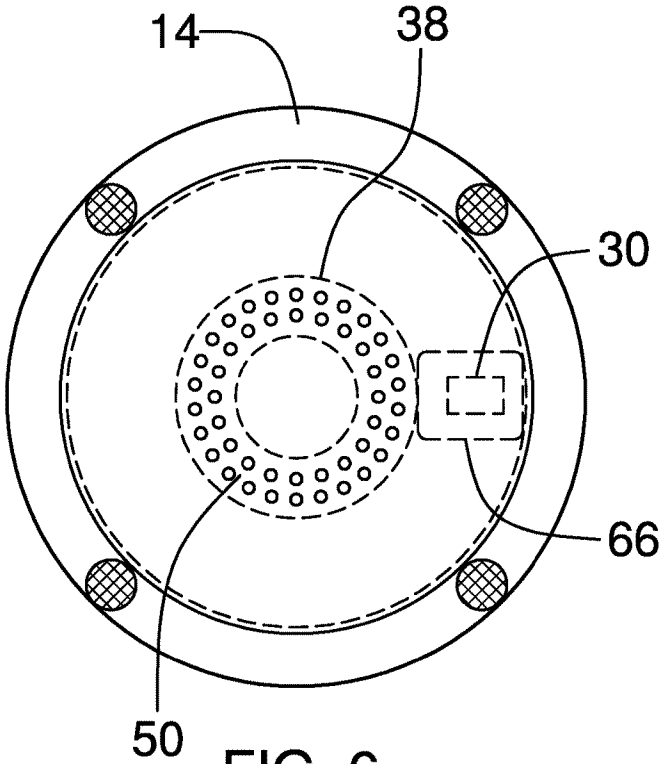
FIG. 6 is a bottom phantom view of an embodiment of the disclosure.
Figure 5:
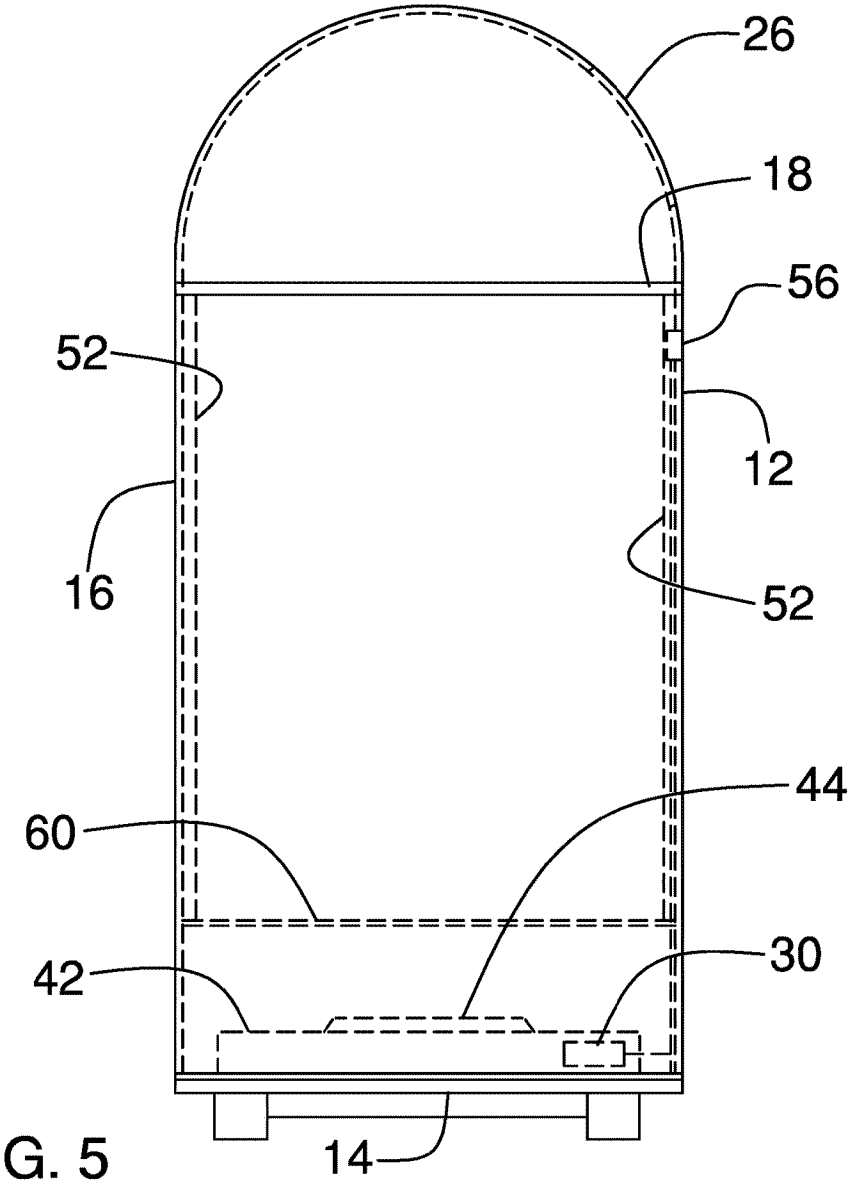
FIG. 5 is a front phantom view of an embodiment of the disclosure.

With reference now to the drawings, and in particular to FIGS. 1 through 6 thereof, a new refuse container device embodying the principles and concepts of an embodiment of the disclosure and generally designated by the reference numeral 10 will be described.

As best illustrated in FIGS. 1 through 6, the vacuuming refuse container assembly 10 generally comprises a refuse container 12 for receiving refuse for disposal. The refuse container 12 has a bottom wall 14 and a perimeter wall 16 extending upwardly therefrom, and the perimeter wall 16 has a distal edge 18 with respect to the bottom wall 14 defining an opening 20 into the refuse container 12. The perimeter wall 16 has an inside surface 22 and the refuse container 12 may have the shape of a cylindrical garbage can or any other shape commonly associated with garbage cans.

A lid 26 is removably positioned on the refuse container 12 and the lid 26 has a refuse opening 28 extending therethrough for receive the refuse. The lid 26 may have a dome shape and the lid 26 rests on the distal edge 18 of the perimeter wall 16 of the refuse container 12. A control circuit 30 is coupled to the refuse container 12 and the control circuit 30 receives a vacuum input.

A vacuum unit 32 is positioned within the refuse container 12 and the vacuum unit 32 is electrically coupled to the control circuit 30. Moreover, the vacuum unit 32 is in fluid communication with the refuse opening 28 in the lid 26 to urge air inwardly through the refuse opening 28 when the vacuum unit 32 is turned on. In this way refuse that is placed in the refuse opening 28 is drawn downwardly into the refuse container 12. The vacuum unit 32 comprises a housing 34 that is coupled to the bottom wall 14 of the refuse container 12. The housing 34 has an intake 36 and an exhaust 38. The exhaust 38 is directed downwardly through the bottom wall 14 and the intake 36 is directed upwardly within the refuse container 12. Thus, the intake 36 is in fluid communication with the refuse opening 28 in the lid 26 when the lid 26 is positioned on the refuse container 12.

A vacuum 40 is positioned within the housing 34 and the vacuum 40 is in fluid communication with each of the intake 36 and the exhaust 38 in the housing 34. The vacuum 40 urges air inwardly through the intake 36 and outwardly through the exhaust 38 when the vacuum 40 is turned on. Additionally, the vacuum 40 is electrically coupled to the control circuit 30 and the vacuum 40 is turned on when the control circuit 30 receives the vacuum input. The vacuum 40 may be an electric vacuum of any conventional design, and the vacuum 40 may or may not include an electric motor and a fan.

The housing 34 has a top wall 42, and the top wall 42 has a plateau section 44 that is centrally positioned on the top wall 42. The intake 36 may comprise a plurality of apertures 46 that each extends through the top wall 42 of the housing 34. An intake screen 48 is coupled to the housing 34 and the intake screen 48 is comprised of an air permeable material for passing air therethrough. Additionally, the intake screen 48 covers the intake 36 to inhibit refuse from entering and potentially clogging the intake 36. A plurality of the intake screens 48 may be provided, and each of the intake screens 48 may be aligned with a respective one of the apertures 46 in the top wall 42 of the housing 34. An exhaust screen 50 is coupled to the housing 34 and the exhaust screen 50 is comprised of an air permeable material for passing air therethrough.

A plurality of conduits 52 is provided and each of the conduits 52 is coupled to the inside surface 22 of the perimeter wall 16 of the refuse container 12. Each of the conduits 52 is vertically oriented in the refuse container 12 and each of the conduits 52 is in fluid communication with the vacuum 40 in the housing 34. Moreover, each of the conduits 52 has a plurality of suction ports 54 and each of the suction ports 54 sucks air inwardly into the conduits 52 when the vacuum 40 is turned on. In this way air can still be urged inwardly through the refuse opening 28 when the intake 36 on the vacuum 40 becomes clogged.

A motion sensor 56 is provided and the motion sensor 56 is coupled to the refuse container 12. The motion sensor 56 is aligned with the refuse opening 28 to sense motion of refuse being thrown into the refuse opening 28. Moreover, the motion sensor 56 is electrically coupled to the control circuit 30 and the control circuit 30 receives the vacuum input when the motion sensor 56 senses motion. The motion sensor 56 may be an electronic motions sensor of any conventional design, and the motion sensor 56 may be mounted on a respective one of the conduits 52.

A plurality of cage supports 58 is provided and each of the cage supports 58 is coupled to and extends inwardly from the inside surface 22 of the perimeter wall 16 of the refuse container 12. Additionally, each of the cage supports 58 is spaced upwardly from the vacuum unit 32. The cage supports 58 are spaced apart from each other and are distributed around the perimeter wall 16 of the refuse container 12. A cage 60 is removably positionable within the refuse container 12 for protecting the vacuum unit 32 from becoming clogged with refuse. The cage 60 has a lower wall 62 and an outer wall 64 extending upwardly therefrom, and the lower wall 62 rests on each of the cage supports 58 when the cage 60 is positioned in the refuse container 12. Additionally, the outer wall 64 is spaced from and is co-arcuate with the perimeter wall 16 of the refuse container 12 when the cage 60 is positioned in the refuse container 12.

A power supply 66 is provided and the power supply 66 is coupled to the refuse container 12. The power supply 66 is electrically coupled to the control circuit 30. Additionally, the power supply 66 comprises at least one battery. The power supply 66 may alternatively comprise a power cord that can be plugged into a female electrical outlet or the like.

In use, the refuse container 12 is positioned in an area that is accessible to users for collecting refuse. The motion sensor 56 senses the motion of the refuse when the refuse is placed in the refuse opening 28 in the lid 26. Thus, the vacuum 40 is turned on to suctionally urge the refuse fully into the refuse container 12. In this way the vacuum 40 helps to ensure that any refused placed into the refuse opening 28 is drawn fully into the refuse container 12. The cage 60 is removable from the refuse container 12 at any time for emptying the refuse container 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A vacuuming refuse container assembly being configured to employ suction to urge refuse into a refuse container, said assembly comprising:

a refuse container for receiving refuse for disposal, wherein said refuse container has a bottom wall and a perimeter wall extending upwardly therefrom, said perimeter wall having a distal edge with respect to said bottom wall defining an opening into said refuse container, said perimeter wall having an inside surface;

a lid being removably positioned on said refuse container, said lid having a refuse opening extending therethrough wherein said refuse opening is configured to receive the refuse;

a control circuit being coupled to said refuse container, wherein said control. circuit receives a vacuum input;

a vacuum unit being positioned within said refuse container, said vacuum unit being electrically coupled to said control circuit, said vacuum unit being in fluid communication with said refuse opening in said lid wherein said vacuum unit is configured to urge air inwardly through said refuse opening when said vacuum unit is turned on thereby facilitating refuse placed in said refuse opening to be drawn downwardly into said refuse container; and a motion sensor being coupled to said refuse container, said motion sensor being aligned with said refuse opening wherein said motion sensor is configured to sense motion of refuse being thrown into said refuse opening, said vacuum unit being turned on when said motion sensor senses motion; and wherein said vacuum unit comprises a housing being coupled to said bottom wall of said refuse container, said housing having an intake and an exhaust, said exhaust being directed downwardly through said bottom wall, said intake being directed upwardly within said refuse container such that said intake is in fluid communication with said refuse opening in said lid when said lid is positioned on said refuse container, a vacuum being positioned within said housing, said vacuum being in fluid communication with each of said intake and said exhaust in said housing, said vacuum urging air inwardly through said intake and outwardly through said exhaust when said vacuum is turned on, said vacuum being electrically coupled to said control circuit, said vacuum being turned on when said control circuit receives said vacuum input, and a plurality of conduits, each of said conduits being coupled to said inside surface of said perimeter wall of said refuse container, each of said conduits being vertically oriented in said refuse container, each of said conduits being in fluid communication with said vacuum in said housing, each of said conduits having a plurality of suction ports wherein each of said suction ports is configured to suck air inwardly into said conduits when said vacuum is turned on thereby facilitating air to be urged inwardly through said refuse opening when said intake becomes clogged.

2. The assembly according to claim 1, further comprising an intake screen being coupled to said housing, said intake screen being comprised of an air permeable material for passing air therethrough, said intake screen covering said intake wherein said intake screen is configured to inhibit refuse from entering and potentially clogging said intake; and an exhaust screen being coupled to said housing, said exhaust screen being comprised of an air permeable material for passing air therethrough, screen covering said exhaust.

3. The assembly according to claim 1, wherein said motion sensor is electrically coupled to said control circuit, said control circuit receiving said vacuum input when said motion sensor senses motion.

4. The assembly according to claim 1, further comprising a plurality of cage supports, each of said cage supports being coupled to and extending inwardly from said inside surface of said perimeter wall of said refuse container, each of said cage supports being spaced upwardly from said vacuum unit.

5. The assembly according to claim 4, further comprising a cage being removably positionable within said refuse container for protecting said vacuum unit from becoming clogged with refuse, said cage having a lower wall and an outer wall extending upwardly therefrom, said lower wall resting on each of said cage supports having said outer wall being spaced from and being co-arcuate with said perimeter wall of said refuse container.

6. The assembly according to claim 1, further comprising a power supply being coupled to said refuse container, said power supply being electrically coupled to said control circuit, said power supply comprising at least one battery.

7. A vacuuming refuse container assembly being configured to employ suction to urge refuse into a refuse container, said assembly comprising:

a refuse container for receiving refuse for disposal, said refuse container having a bottom wall and a perimeter wall extending upwardly therefrom, said perimeter wall having a distal edge with respect to said bottom wall defining an opening into said refuse container, said perimeter wall having an inside surface, said bottom wall having a top surface;

a lid being removably positioned on said refuse container, said lid having a refuse opening extending therethrough wherein said refuse opening is configured to receive the refuse;

a control circuit being coupled to said refuse container, said control circuit receiving a vacuum input;

a vacuum unit being positioned within said refuse container, said vacuum unit being electrically coupled to said control circuit, said vacuum unit being in fluid communication with said refuse opening in said lid wherein said vacuum unit is configured to urge air inwardly through said refuse opening when said vacuum unit is turned on thereby facilitating refuse placed in said refuse opening to be drawn downwardly into said refuse container, said vacuum unit comprising:

a housing being coupled to said bottom wall of said refuse container, said housing having an intake and an exhaust, said exhaust being directed downwardly through said bottom wall, said intake being directed upwardly within said refuse container such that said intake is in fluid communication with said refuse opening in said lid when said lid is positioned on said refuse container;

a vacuum being positioned within said housing, said vacuum being in fluid communication with each of said intake and said exhaust in said housing, said vacuum urging air inwardly through said intake and outwardly through said exhaust. when said vacuum is turned on, said vacuum being electrically coupled to said control circuit, said vacuum being turned on when said control circuit receives said vacuum input;

an intake screen being coupled to said housing, said intake screen being comprised of an air permeable material for passing air therethrough, said intake screen covering said intake wherein said intake screen is configured to inhibit refuse from entering and potentially clogging said intake;

an exhaust screen being coupled to said housing, said exhaust screen being comprised of an air permeable material for passing air therethrough, screen covering said exhaust; and a plurality of conduits, each of said conduits being coupled to said inside surface of said perimeter wall of said refuse container, each of said conduits being vertically oriented in said refuse container, each of said conduits being in fluid communication with said vacuum in said housing, each of said conduits having a plurality of suction ports wherein each of said suction ports is configured to suck air inwardly into said conduits when said vacuum is turned on thereby facilitating air to be urged inwardly through said refuse opening when said intake becomes clogged;

a motion sensor being coupled to said refuse container, said motion sensor being aligned with said refuse opening wherein said motion sensor is configured to sense motion of refuse being thrown into said refuse opening, said motion sensor being electrically coupled to said control circuit, said control circuit receiving said vacuum input when said motion sensor senses motion:

a plurality of cage supports, each of said cage supports being coupled to and extending inwardly from said inside surface of said perimeter wall of said refuse container, each of said cage supports being spaced upwardly from said vacuum unit;

a cage being removably positionable within said refuse container for protecting said vacuum unit from becoming clogged with refuse, said cage having a lower wall and an outer wall extending upwardly therefrom, said lower wall resting on each of said cage supports having said outer wall being spaced from and being co-arcuate with said perimeter wall of said refuse container; and a power supply being coupled to said refuse container, said power supply being electrically coupled to said control circuit, said power supply comprising at least one battery.

* * * * *